US009869329B2

(12) United States Patent
Liu et al.

(10) Patent No.: US 9,869,329 B2
(45) Date of Patent: Jan. 16, 2018

(54) POSITIONAL STOP DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Yu-Ching Liu, New Taipei (TW); Fu-Chi Yang, New Taipei (TW); Shun-Tung Chen, New Taipei (TW); Wei-Da Yang, New Taipei (TW); Li-Quan Zhang, Shenzhen (CN); Qing Cai, Shenzhen (CN); Xiao-Cong Yao, Shenzhen (CN); Yuan-Qiang Long, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 90 days.

(21) Appl. No.: 15/141,850

(22) Filed: Apr. 29, 2016

(65) Prior Publication Data

US 2016/0327072 A1 Nov. 10, 2016

(30) Foreign Application Priority Data

May 7, 2015 (CN) ..... 2015 1 0226512

(51) Int. Cl.
*F15B 15/26* (2006.01)
*G05G 5/06* (2006.01)

(52) U.S. Cl.
CPC ..... *F15B 15/261* (2013.01); *F15B 15/265* (2013.01); *G05G 5/06* (2013.01)

(58) Field of Classification Search
CPC ..... F16H 2061/243; F16H 2061/247; G05G 5/06; G05G 5/08; G05G 5/12; G05G 5/14;
(Continued)

(56) References Cited

U.S. PATENT DOCUMENTS 4,160,143 A * 7/1979 Schlesier ..... G05G 1/02 200/539
5,226,342 A * 7/1993 Panin ..... G05G 5/06 188/82.2
(Continued)

FOREIGN PATENT DOCUMENTS

DE 4109228 A1 * 9/1992 ..... E05B 77/50

*Primary Examiner* — Adam D Rogers
(74) *Attorney, Agent, or Firm* — ScienBiziP, P.C.

(57) ABSTRACT

A positional stop device includes a base body, a lever, a driving element, and a retaining member. The lever is rotatablely arranged on the base body, a first end of the lever couples to the driving element, and a second end of the lever couples to the retaining member. The driving element is partially exposed out of the base body. The retaining member is moveablely received in the base body. When the slider of a pneumatic rodless cylinder slides along a first direction, the driving element is driven by the slider to move along a second direction and be fully received in the base body. The lever is driven by the driving element to rotate around the base body. The retaining member is driven by the lever to move along a third direction and to be partially exposed out of the base body to stops the slider from sliding.

11 Claims, 9 Drawing Sheets

(58) Field of Classification Search
CPC .. G05G 5/18; G05G 5/20; G05G 5/24; G05G 2700/06; G05G 2700/08; F15B 15/261; F15B 15/265; E05B 2063/0026; E05B 65/0829
See application file for complete search history.

(56) References Cited

U.S. PATENT DOCUMENTS

| | | | | |
|---|---|---|---|---|
| 9,687,973 | B2 * | 6/2017 | Jin | B25B 23/065 |
| 2014/0166826 | A1 * | 6/2014 | Liao | F16M 11/041 248/158 |

* cited by examiner

POSITIONAL STOP DEVICE

CROSS-REFERENCE TO RELATED APPLICATIONS

This application claims priority to Chinese Patent Application No. 201510226512.4 filed on May 7, 2015, the contents of which are incorporated by reference herein.

FIELD

The subject matter herein generally relates to a positional stop device.

BACKGROUND

Generally, pneumatic rodless cylinders are widely used in automated production lines for transmitting materials. A pneumatic rodless cylinder usually includes a slider and a cylinder body. The materials to be transmitted are arranged on the slider, the pneumatic rodless cylinder transmits the materials by controlling the slider to slide along the cylinder body.

BRIEF DESCRIPTION OF THE DRAWINGS

Implementations of the present technology will now be described, by way of example only, with reference to the attached figures, wherein.

DETAILED DESCRIPTION

Figure 1:
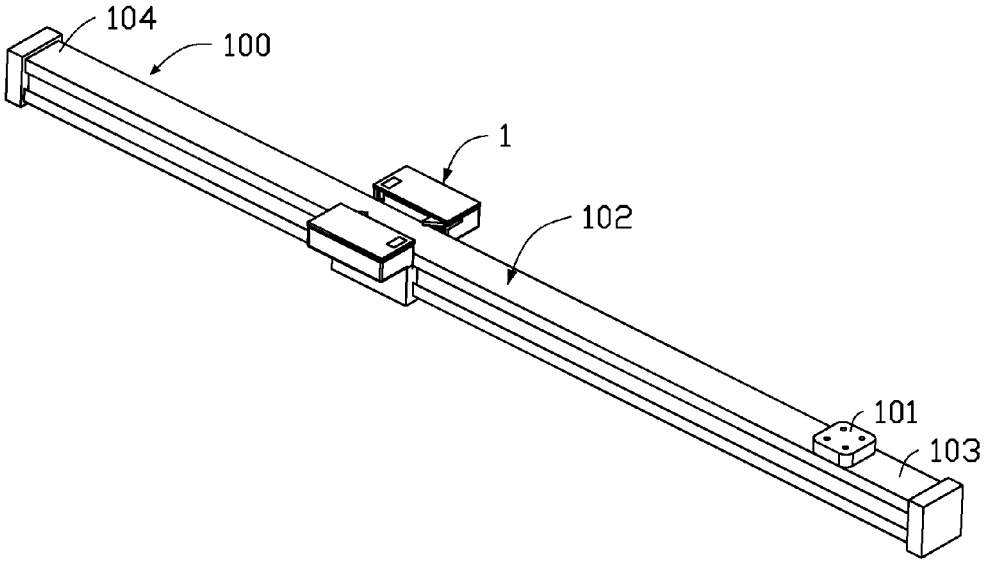
FIG. 1 is a diagrammatic view of one embodiment of a positional stop device and a pneumatic rodless cylinder to which the positional stop device is applied.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The present disclosure, including the accompanying drawings is illustrated by way of examples and not by way of limitation. Several definitions that apply throughout this disclosure will now be presented. It should be noted that references to "an" or "one" embodiment in this disclosure are not necessarily to the same embodiment, and such references mean "at least one."

Furthermore, the term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
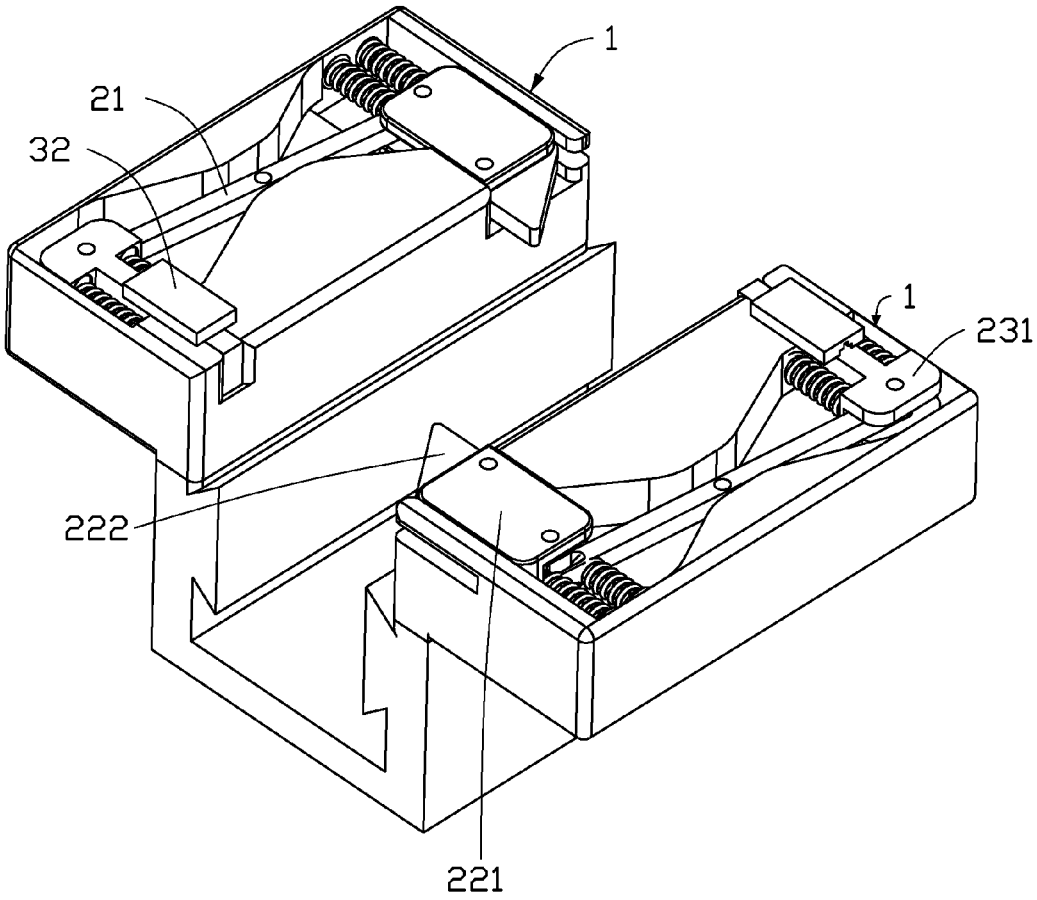
FIG. 2 is a diagrammatic view of the positional stop device of FIG. 1 which is lack of a cover.

FIG. 1 illustrates a positional stop device 1 and a pneumatic rodless cylinder 100. FIG. 2 illustrates the positional stop device 1. The positional stop device 1 can be applied to a pneumatic rodless cylinder 100. The pneumatic rodless cylinder 100 includes a slider 101 and a cylinder body 102. In other embodiment, the slider 101 can be named as an air-powered carrier. The cylinder body 102 can be named as a support track. The slider 101 is slidablely arranged on the cylinder body 102. The cylinder body 102 includes a first end 103 and a second end 104. The first end 103 is opposite to the second end 104. A slide trace (not shown) is formed on the cylinder body 102 between the first end 103 and the second end 104. The slider 101 slides along the slide trace. In the illustrated embodiment, the pneumatic rodless cylinder 100 cooperates with two positional stop devices 1. As shown in FIG. 2, the two positional stop devices 1 are respectively arranged at two opposite sides of the pneumatic rodless cylinder 100 via sticking up.

Figure 3:
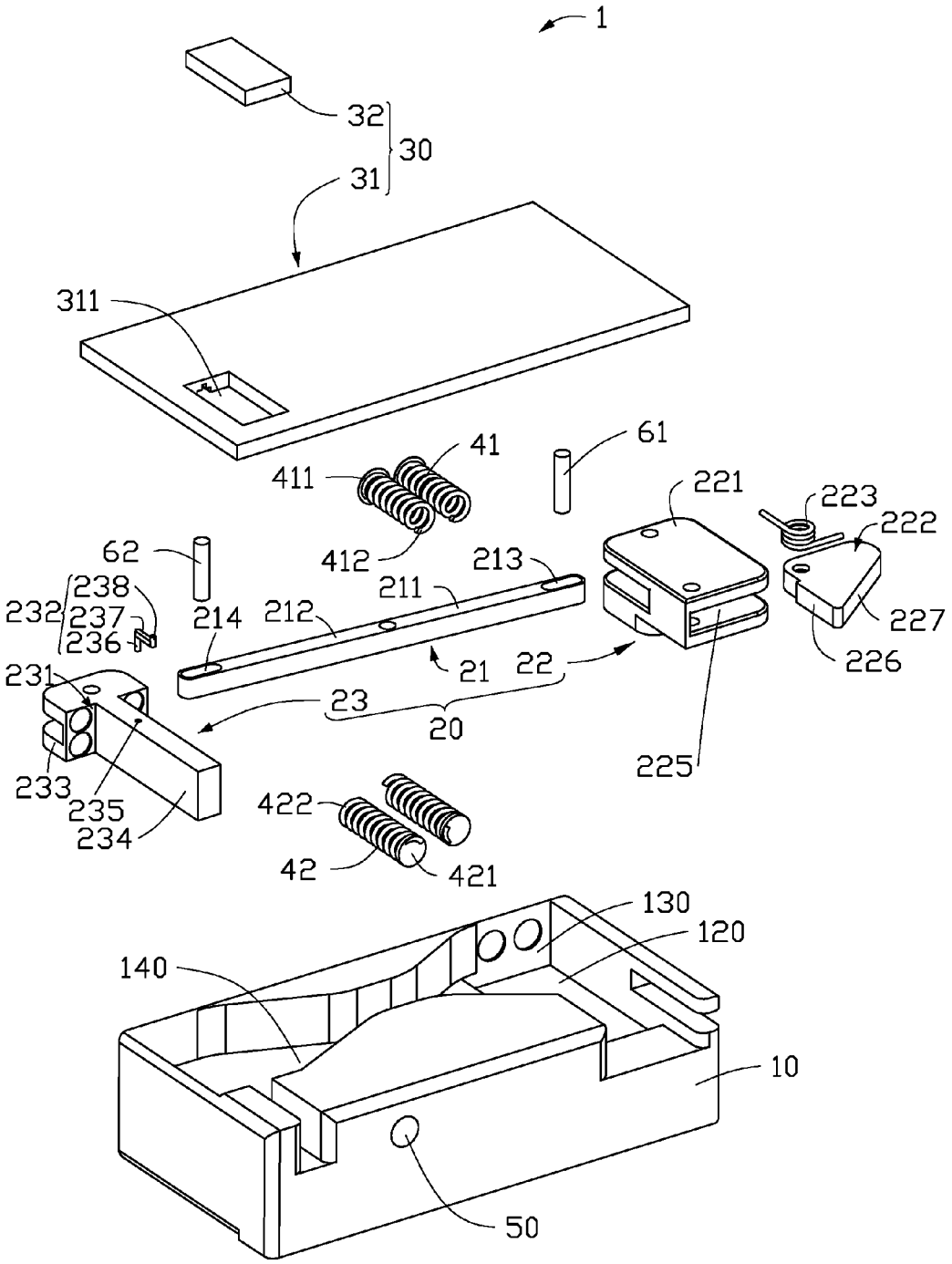
FIG. 3 is an explosive, isometric view of the positional stop device of FIG. 1 in a first perspective.
Figure 4:
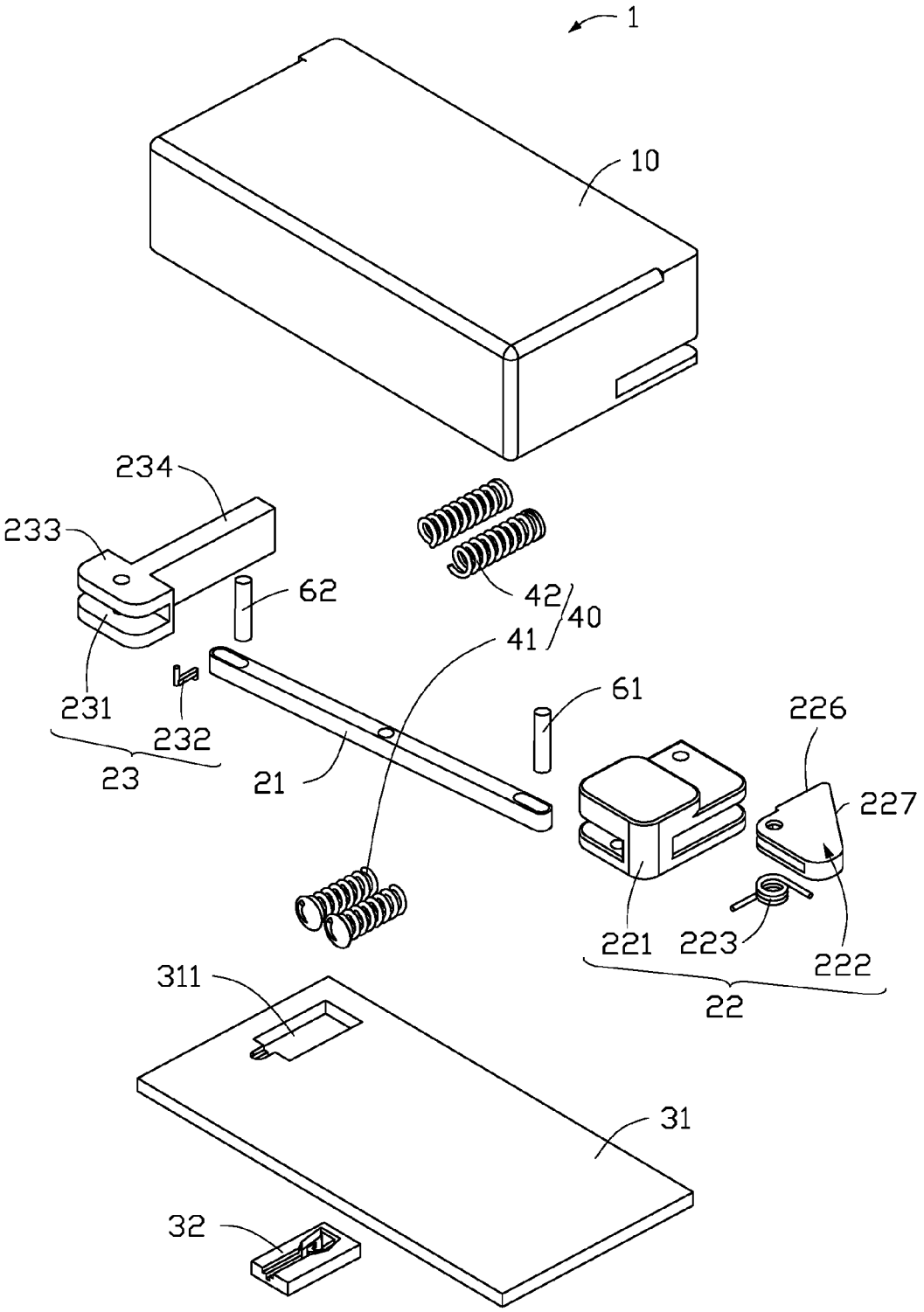
FIG. 4 is an explosive, isometric view of the positional stop device of FIG. 1 in a second perspective.

FIG. 3 illustrates the positional stop device 1 in a first perspective. FIG. 4 illustrates the positional stop device 1 in a second perspective. The positional stop device 1 includes a base body 10, a transmission assembly 20, a cover 30, a reset assembly 40, and a sensor 50. A receiving space 120 is defined in the base body 10 for receiving the transmission assembly 20 and the reset assembly 40. The transmission assembly 20 is rotatablely arranged on the base body 10. The slider 101 slides along the cylinder body 102 to drive the transmission assembly 20 to rotate in the base body 10 and to partially be exposed out of the base body 10. The exposed portion of the transmission assembly 20 can stop the slider 101 from sliding, thus to make the slider 101 stay on a position of the cylinder body 102. The reset assembly 40 can reposition the transmission assembly 20. The sensor 50 can sense the slider 101 when the slider 101 is stopped to stay on a position of the cylinder body 102 and further generate a signal accordingly. A processor (not shown) can change a driving direction of the pneumatic rodless cylinder 100 in response to the signal generated by the sensor 50.

The transmission assembly 20 includes a lever 21, a driving element 22, and a retaining member 23. The lever 21 is rotatablely arranged on the base body 10. In the illustrated embodiment, the lever 21 is arranged on the base body 10 via a pin and rotates around the pin. The lever 21 includes a first end 211 and a second end 212 opposite each other. The first end 211 of the lever 21 couples to the driving element 22, the second end 212 of the lever 21 couples to the retaining member 23. A first slide slot 213 is defined in the first end 211, and a second slide slot 214 is defined in the second end 212. The transmission assembly 20 further includes a pair of fasteners including a first fastener 61 and a second fastener 62. The driving element 22 couples to the first end 211 via the first fastener 61. The retaining member 23 couples to the second end 212 via the second fastener 62.

In the embodiment, the first fastener 61 passes through the driving element 22 and is received in the first slide slot 213. The first fastener 61 can slide along the first slide slot 213 and can rotate in the first slide slot 213, thereby the driving element 22 is rotatablely coupled to the first end 211 of the lever 21. The second fastener 62 passes through the retaining member 23 and is received in the second slide slot 214. The second fastener 62 can slide along the second slide slot 214 and can rotate in the second slide slot 214, thereby the retaining member 23 is rotatablely coupled to the second end 212 of the lever 21. In the embodiment, the first fastener 61 and the second fastener 62 are shaft shaped.

The driving element 22 is moveablely received in the base body 10. The driving element 22 includes a driving body 221, a driving portion 222, and an elastic portion 223. The driving body 221 couples to the first end 211 of the lever 21. The driving portion 222 rotatablely couples to the driving body 221. A receiving chamber 225 is defined in the driving body 221 for receiving the driving portion 222. In the illustrated embodiment, the driving portion 223 is substantially right triangle shaped. A first side wall 226 and a second side wall 227 of the driving portion 222 are near each other. The first side wall 226 corresponds to a right angle side. The second side wall 227 corresponds to a hypotenuse. In an initial state (as shown in FIG. 6A), the driving portion 222 is rotated out of the receiving chamber 225, the first side wall 226 and the second side wall 227 are exposed out of the base body 10 and locate upon the cylinder body 102. When the slier 101 slides along the cylinder body 102, the second side wall 227 of the driving portion 222 is hold by the slider 101, the driving portion 222 is driven by the slider 101 to move until fully received in the receiving chamber 225 when the first side wall 226 of the driving portion 222 contacts with the slider 101. One end of the elastic portion 223 is coupled to the driving portion 222; and another end of the elastic portion 223 is coupled to the driving body 221. The elastic portion 223 can supply elastic force to the driving portion 222, thus repositioning the driving portion 222.

Referring to FIGS. 3 and 4, the retaining member 23 is moveablely received in the base body 10. The retaining member 23 includes a retaining element 231 and a locking element In the embodiment, the retaining element 231 is substantially T shaped. In an alternative embodiment, the retaining element 231 is substantially L shaped. The retaining element 231 includes a retaining body 233 and a retaining arm 234. The retaining arm 234 extends out of one end of the retaining body 233. The retaining arm 234 defines a receiving hole 235 for partially receiving the locking element 232. In the embodiment, the locking element 232 is Z shaped. The locking element 232 includes a first bar 236, a connecting bar 237, and a second bar 238. The first bar 236 and the second bar 238 couple to the connecting bar 237. In an alternative embodiment, the first bar 236 and the second bar 238 perpendicularly couple to the connecting bar 237. The first bar 236 is received in the receiving hole 235. The connecting bar 237 and the second bar 238 are exposed out of the receiving hole 235.

The cover 30 includes a cover body 31 and a guide plate 32. The cover body 31 fixes on the base body 10. In the embodiment, the cover body 31 defines a locating slot 311 corresponding to a position of the retaining element 231 for receiving the guide plate 32.

Figure 5:
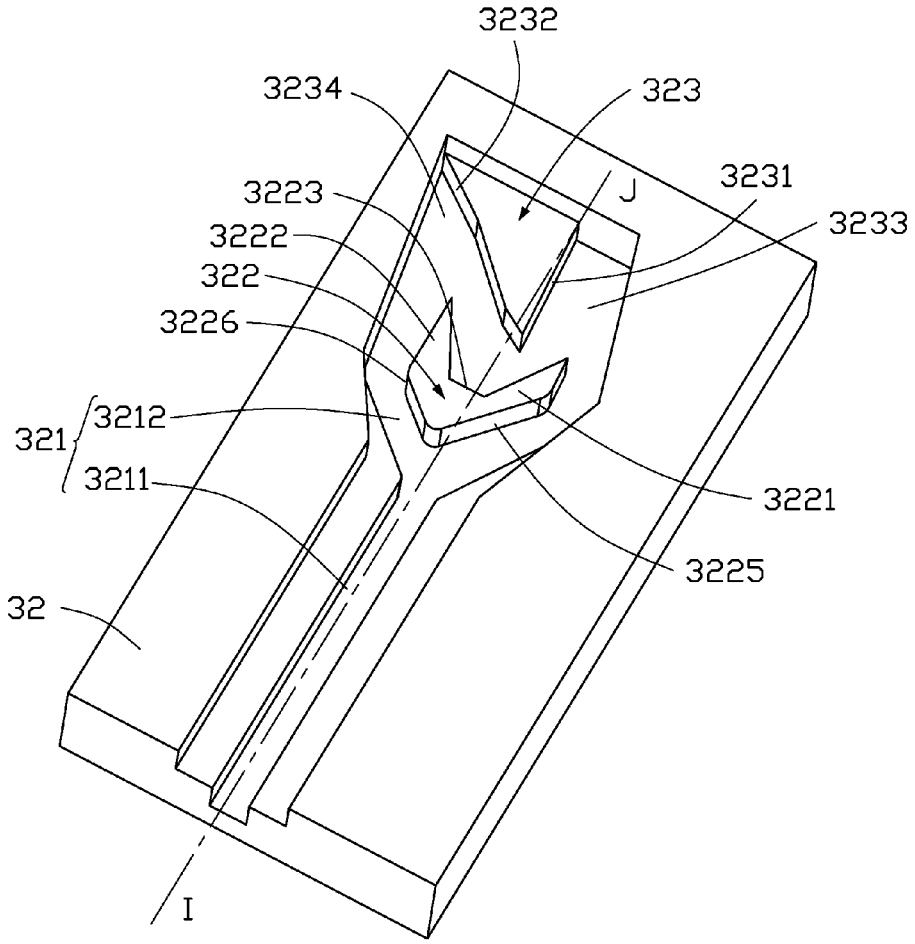
FIG. 5 is a diagrammatic view of a guiding board of the positional stop device of FIG. 1.

FIG. 5 illustrates the guide plate 32. The guide plate 32 includes a guide slot 321, a position block 322, and a guide block 323. The guide slot 321, the position block 322 and the guide block 323 all face to the retaining element 231 The second bar 238 of the locking element 232 is received in the guide slot 321.

In the embodiment, the guide slot 321 includes a first guide slot 3211 and a second guide slot 3212. The first guide slot 3211 connects to the second guide slot 3212. In an initial state (as shown in FIG. 7A), the second bar 238 is received in the first guide slot 3211. The second bar 238 can slide along the first guide slot 3211, which forms a straight line I. The position block 322 and the guide block 323 are protruded from the bottom of the second guide slot 3212. The position block 322 is arranged between the first guide slot 3211 and the guide block 323. In the embodiment, the position block 322 is V shaped. The position block 322 includes a first block body 3221 and a second block body 3222. The first block body 3221 is fixed and inclines to the second block body 3222. A limit space 3223 is defined by the first block body 3221 and the second block body 3222. The first block body 3221 includes a first side wall 3225. The second block body 3222 includes a second side wall 3226. The first side wall 3225 connects to the second side wall 3226. In the illustrated embodiment, the guide block 323 is triangle shaped. in an alternative embodiment, the guide block 323 is substantially V shaped. The guide block 323 includes a first guide wall 3231 and a second guide wall 3232. The first guide wall 3231 obliquely connects to the second guide wall 3232. An inlet passage 3233 is formed by the first guide wall 3231 and the second guide slot 3212. An outlet passage 3234 is formed by the second guide wall 3232 and the second guide slot 3212. The inlet passage 3233 connects to the outlet passage 3234 via the limit space 3223. The second bar 238 can be guide by the first side wall 3225 of the first block body 3221 to slide into the inlet passage 3233. The second bar 238 can further enter into the limit space 3223 by passing through the inlet passage 3233. The second bar 238 can slide to leave the limit space 3223 through the outlet passage 3234, and further be guided by the second side wall 3226 of the second block body 3222 to slide into the first guide slot 3211 from the outlet passage 3234.

Referring, to FIGS. 3 and 4, one end of the reset assembly 40 couples to the base body 10, another end couples to the transmission assembly 20. The reset assembly 40 can supply a reset fore for the transmission assembly 20, thus to reset the transmission assembly 20. The reset assembly 40 includes at least a first reset element 41 and at least a second reset element 42. In the illustrated embodiment, the reset assembly 40 includes two first reset elements 41 and two second reset elements 42. Each first reset element 41 includes a first end 411 and a second end 412 arranged opposite each other. The first end 411 couples to a first inner wall 130 of the base body 10, the second end 412 couples to the driving element 22. The first reset element 41 can supply an elastic force for the driving element 22, which enables the driving element 22 to return to the initial position. Each second reset element 42 includes a first end 421 and a second end 422 arranged opposite each other. The first end 421 couples to a second inner wall 140 of the base body 10 which is opposite to the first inner wall 130, the second end 422 couples to the retaining element 23. The second reset element 42 can supply an elastic force for the retaining element 23, which enable the retaining element 23 to return to the initial position.

Referring to FIG. 3, the sensor 50 is arranged on the base body 10 and connects to a processor (not shown h The sensor 50 can sense the slider 101 when the slider 101 is stopped to stay on the cylinder body 102 and generates a signal according to the sensed slide stop. The processor (not shown) can change a driving direction in the pneumatic rodless cylinder 100 when the signal generated by the sensor 50 lasts for a preset time such as 9 seconds. That is, the slider 101 stops to slide and stays on a position for 9 seconds.

Figure 6:
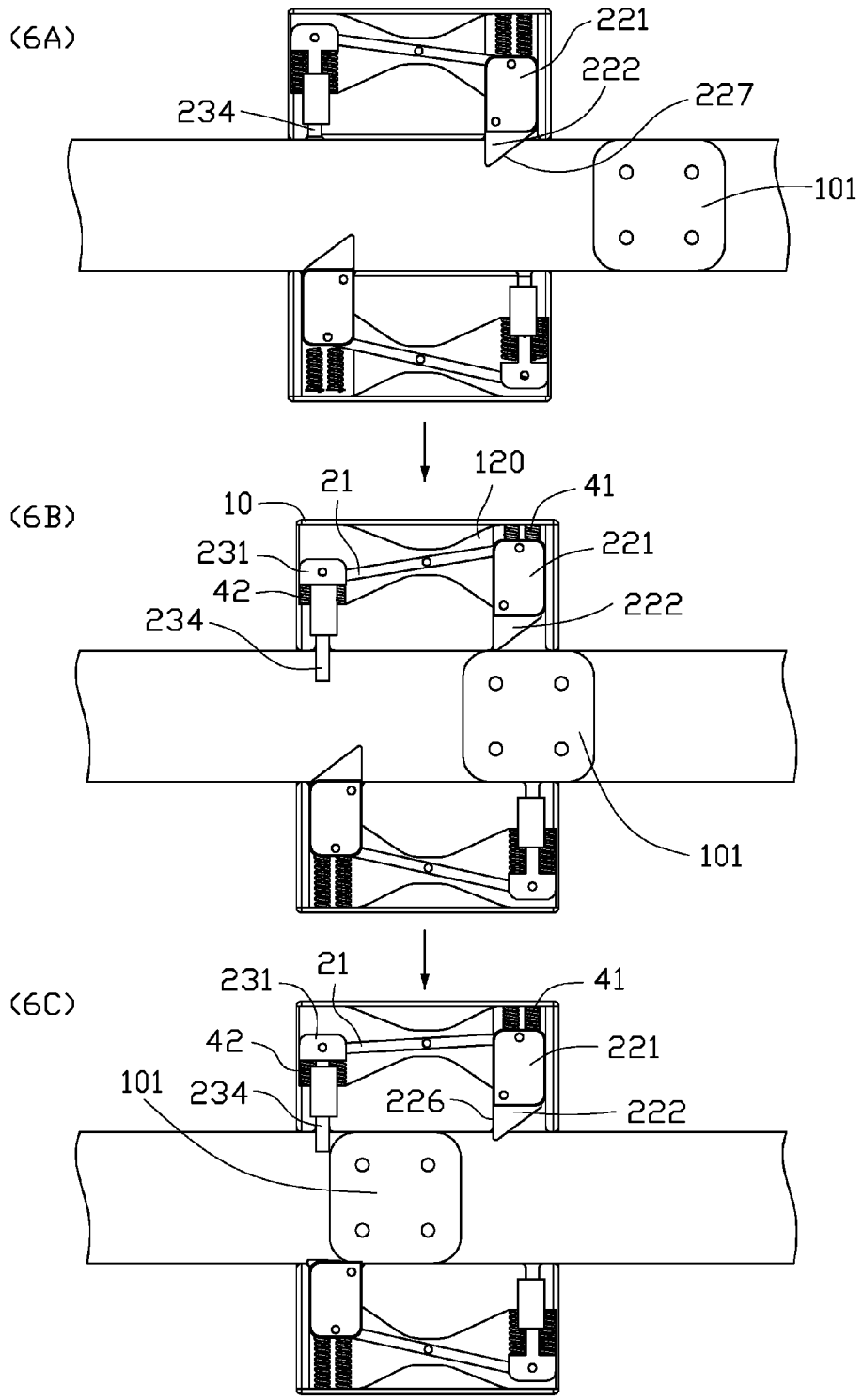
FIG. 6 illustrates a process of a slider of the pneumatic rodless cylinder of FIG. 1 which slides from a first position far away from the positional stop device of FIG. 1 to a second position where the slider is stopped by the positional stop device.
Figure 7:
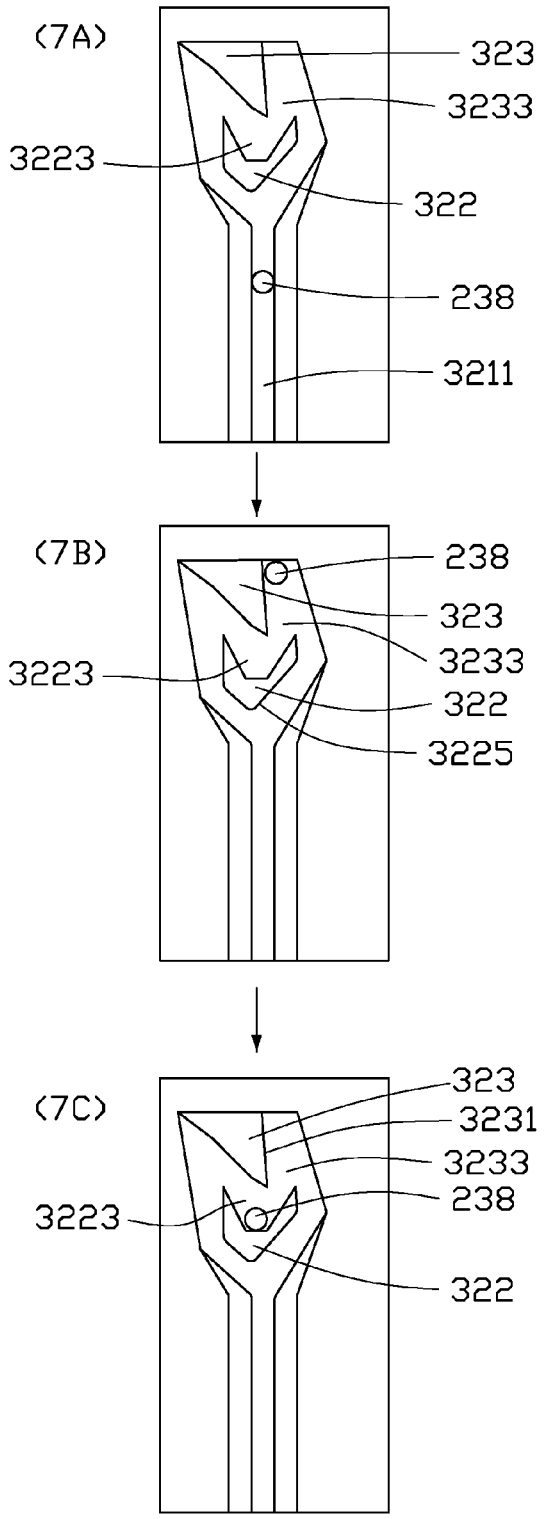
FIG. 7 illustrates a process of a locking element of the positional stop device of FIG. 1 which slides in different positions of a guide plate of the positional stop device corresponding to FIG. 6.

FIGS. 6 and 7 illustrate a process that the slider 101 transmits materials. As shown in FIG. 6A, the slider 101 is firstly driven to slide along the cylinder body 102 from the first end 103 to the second end 104 of the cylinder body 102. A direction from the first end 103 to the second end 104 is named as a first direction. As shown in FIG. 6B, when the slider 101 contacts with the second side wall 227 of the driving portion 222, the slider 101 continues to slide along the first direction, which can drive the driving body 221 to move along a second direction until the driving portion 222 is fully received in the receiving space 120. At this moment, the driving body 221 further compresses the first reset element 41. The second direction is perpendicular to the first direction. The lever 21 is then driven by the driving body 221 to rotate around the base body 10. The retaining element 231 is driven by the lever 21 to move along a third direction and partially exposed out of the receiving space 120. The retaining element 231 further compresses the second reset element 42. In the illustrated embodiment, the third direction is perpendicular to the first direction and is opposite to the second direction. As shown in FIGS. 7A and 7B, in the process as shown from FIG. 6A to FIG. 6B, the locking element 232 is guided by the retaining element 231 to move along the third direction, the second bar 238 slides along the first guide slot 3211 of the guide plate 32 (shown in FIG. 7A). The second bar 238 is further guided by the first side wall 3225 of the position block 322 to slide into the inlet passage 3233 (shown in FIG. 7B). As shown in FIG. 6C, when the slider 101 still slides to pass through the driving portion 222, the first reset element 41 supplies an elastic force for the driving body 221, which enables the driving body 221 to drive the driving portion 222 to slide along the third direction. At same time, the second reset assembly 42 supplies an elastic force for the retaining body 233, which enables the retaining element 231 to slide along the second direction. The lever 21 is driven by the driving body 221 and the retaining element 231 to rotate around the base body 10. The locking element 232 is driven by the retaining element 231 to slide along the second direction. At this moment, as shown in FIG. 7C, the second bar 238 is guided by the first guide wall 3231 of the guide block 323 to slide from the inlet passage 3233 to enter into the limit space 3223 and is last limited in the limit space 3223. Thereby, the retaining member 23 is stopped from sliding along the second direction and partially exposed out of the receiving space 120. The exposition of the retaining member 23 (that is the retaining arm 234) stands with the slider 101 and further stops the slider 101 from sliding along the first direction. The driving body 221 is accordingly stop from still moving, and the driving portion 222 is still partially exposed out of the receiving space 120 and partially stays on the cylinder body 102. By this time, the slider 101 stops and stays on the cylinder body 102, then workers can fetch the materials from or put the materials on the slider 101. The sensor 50 senses a stop of the slider 101 on the cylinder body 102 and can generate a signal. The sensor 50 transmits the signal to the processor. The processor changes a driving direction of the pneumatic rodless cylinder 100 when the signal generated by the sensor 50 lasts for a preset time. Then, the slider 101 is driven to slide back to the initial position along the cylinder body 102 in a fourth direction. In the illustrated embodiment, the fourth direction is opposite to the first direction, that is, the fourth direction is a direction from the second end 104 to the first end 103 of the cylinder body 102. In a process of sliding back, the slider 101 stands against the first side wall 226 of the driving member 22, which enables the driving portion 222 to rotate to be received in the receiving chamber 225 and further compress the elastic portion 223 of the driving element 22, until the slider 101 slides to pass through the driving portion 222. The driving portion 222 can reset in the help of the elastic portion 223 to a state as shown in FIG. 8A. Therefore, the slider 101 can slide back to the first end 103 of the cylinder body 102. At this time, workers can fetch from or put the materials on the slider 101.

Figure 8:
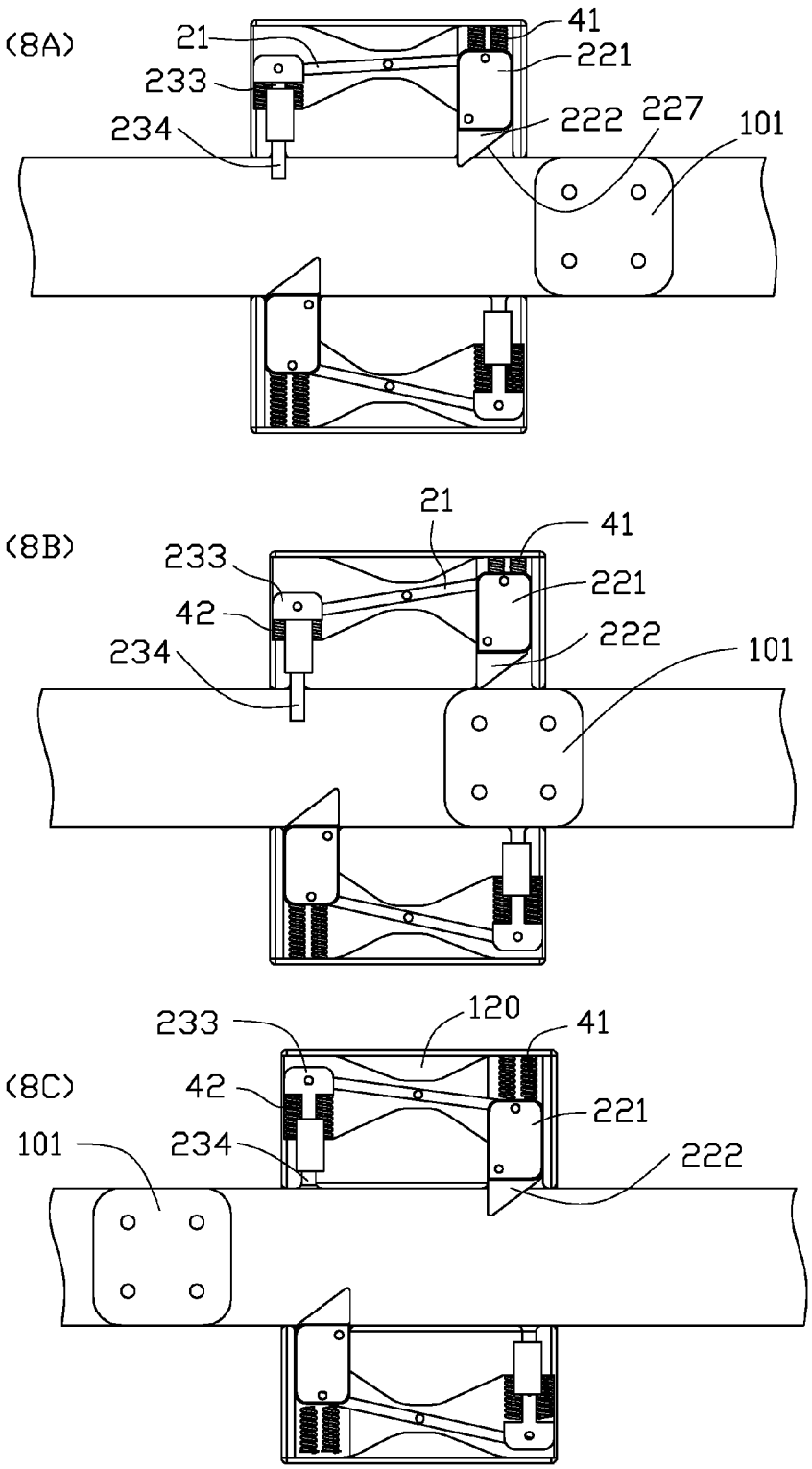
FIG. 8 illustrates a process of the slider of the pneumatic rodless cylinder of FIG. 1 which slides from a first position far away from the positional stop device of FIG. 1 to a third position where the slider passes through the positional stop device.
Figure 9:
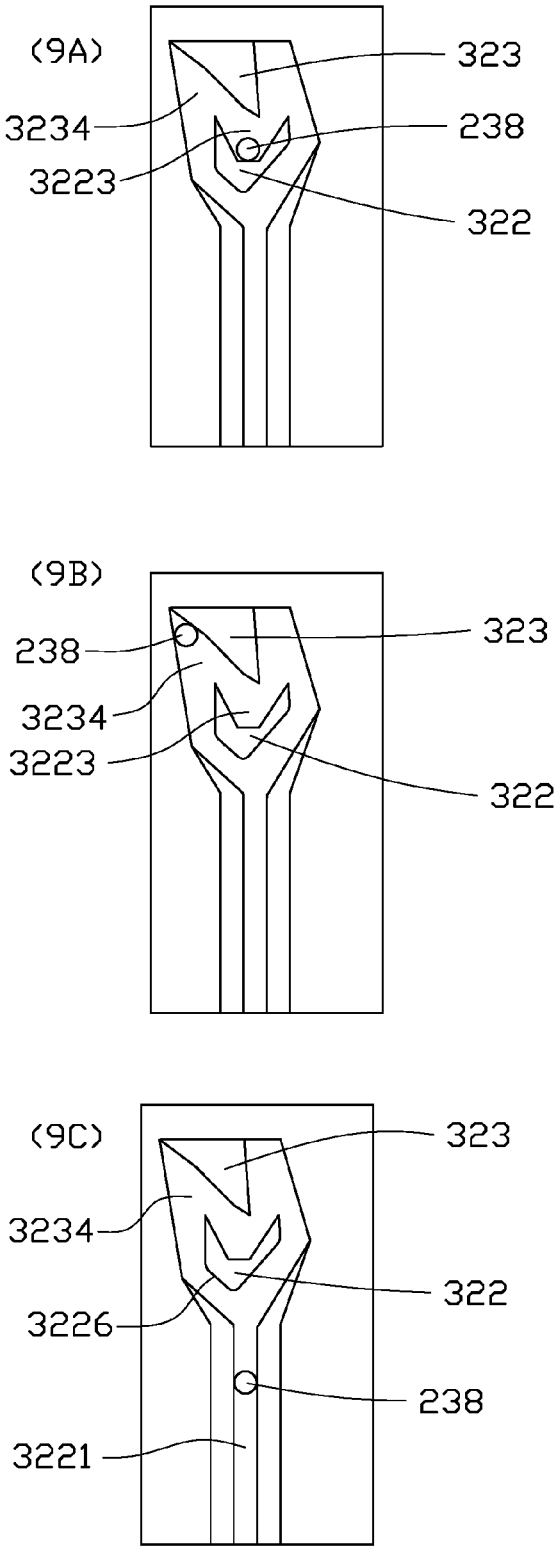
FIG. 9 illustrates a process of the locking element of the positional stop device of FIG. 1 which slides in different positions of a guide plate of the positional stop device corresponding to FIG. 8.

FIGS. 8 and 9 illustrate that the slider 101 slides to pass through the positional stop device 1. As shown in FIG. 8A, after the materials is fetched from or put on the slider 101, the slider 101 is still driven to slide along the cylinder body 102 in the first direction. The slider 101 slides to stand against the second side wall 227 of the driving portion 222, which enables the driving portion 222 to drive the driving body 221 to move along the second direction unit the driving portion 222 is fully received in the receiving space 120. Then, the driving body 221 compresses the first reset element 41. The lever 21 is driven by the driving body 221 to rotate around the base body 10. The retaining member 23 is driven by the lever 21 to move along the third direction until partially exposed out of the receiving space 120. At this time, the retaining member 23 compresses the second reset assembly 42 (as shown in FIG. 8B). In this process, as shown in FIGS. 9A-9B, the locking element 232 is also driven by the retaining member 23 to slide along the third direction, the second bar 238 is driven to leave the limit space 3223 by passed through the outlet passage 3234 of the guide plate 32 and enter into the outlet passage 3234. As shown in FIG. 8C, when the slider 101 slides through the driving portion 222, the first reset assembly 41 supplies an elastic force for the driving body 221, which enables the driving body 221 to drive the driving portion 222 to slide along the third direction until the driving portion 222 is fully exposed out of the receiving space 120. At the same time, the second reset assembly 42 supplies an elastic force for the retaining body 233, which enables the retaining body 233 to slide along the second direction until the retaining arm 234 is fully received in the receiving space 120. The lever 21 is driven by the driving body 221 and the retaining element 231 to rotate around the base body 10. By this time, shown in FIG. 9C, the locking element 232 is also driven by the retaining body 233 to slide along the second direction, the second bar 238 leaves the outlet passage 3234 to enter into the first guide slot 3211 in the guide of the second side wall 3226 of the position block 322. The slider 101 is driven to slide through the retaining arm 234 and until to the second end 104 of the cylinder body 102 (shown in FIG. 1). In this condition, workers can fetch or put the materials on the slider 101.

The positional stop device 1 can make the slider 101 to stop on any need position of the cylinder body 102. And the slider 101 can selectably slide from the first end 103 of the cylinder body 102 to the second end 104 of the cylinder body 102, or then from the second end 104 of the cylinder body 102 back to the first end 103 of the cylinder body 102, which is easy for setting work station at the first end 103 and the second end 104.

The embodiments shown and described above are only examples. Many details are often found in the art such as the other features of the positional stop device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A positional stop device comprising:

a base body defining a receiving space; and a transmission assembly comprising a lever;

a driving element moveablely received in the receiving space, and partially exposed out of the base body; and a retaining member moveablely received in the receiving space; wherein the lever is rotatablely arranged on the base body, a first end of the lever is coupled to the driving element, and a second end of the lever is coupled to the retaining member;

when a slider of a pneumatic rodless cylinder slides along a first direction, the driving element is driven by the slider to move along a second direction and further to be fully received in the receiving space from partially being exposed out of the base body;

the lever is driven by the driving element to rotate around the base body when the driving element moves along the second direction; and the retaining member is driven by the lever to move along a third direction and to be partially exposed out of the receiving space, the exposed retaining member stops the slider from sliding along the first direction and to stay on a cylinder body of the pneumatic rodless cylinder.

2. The positional stop device of claim 1, wherein the second direction is perpendicular to the first direction, the third direction is also perpendicular to the first direction and opposite to the second direction.

3. The positional stop device of claim 1, further comprising a reset assembly, wherein one end of the reset assembly couples to the base body, another end of the reset assembly couples to the transmission assembly, the reset assembly supplies a force for the transmission assembly, which repositions the transmission assembly.

4. The positional stop device of claim 1, wherein the retaining member comprises a retaining element and a locking element; the retaining element couples to the second end of the lever, the locking element partially received in the retaining element;

the positional stop device further comprises a guide plate arranged on the base body corresponding to a position of the retaining element;

the guide plate comprises a guide slot, a position block, and a guide block; the guide slot, the position block, and the guide block face to the retaining element; the locking element is received in the guide slot; the position block and the guide block are protruded from the bottom of the guide slot; the position block locates between the guide slot and the guide block, the position block defines a limit space; the locking element is driven by the retaining element to move to the guide block along the guide slot when the retaining element moves along the third direction; the locking element is driven by the retaining element and guided by the guide block to move to the limit space when the retaining element moves along the second direction; the retaining element is stopped from moving along the second direction and is partially exposed out of the receiving space when the locking element moves into the limit space, which enables the driving element to be partially exposed out of the receiving space.

5. The positional stop device of claim 4, wherein the retaining element defines a receiving hole for partially receiving the locking element.

6. The positional stop device of claim 5, wherein the locking element is Z shaped and comprises a first bar, a connecting bar, and a second bar; the first bar and the second bar couple to the connecting bar; the first bar is received in the receiving hole; the connecting bar and the second bar are exposed out of the receiving hole; and the second bar is received in the guide slot.

7. The positional stop device of claim 6, wherein the second bar is driven to move along the guide slot when the retaining element moves along the second direction or the third direction; the guide block is substantially V shaped, and comprises a first guide wall and a second guide wall near each other; an inlet passage is formed by the first guide wall and the guide slot, the inlet passage connects to the limit space; and the second bar of the locking element moves into the limit space by passing through the inlet passage.

8. The positional stop device of claim 7, wherein an outlet passage is formed by the second guide wall and the guide slot; the outlet passage connects to the limit space, and the second bar of the locking element moves out of the limit space by passing through the outlet passage.

9. The positional stop device of claim 7, wherein the position block is V shaped, the position block comprises a first block body and a second block body; the first block body is fixed and inclines to the second block body; the limit space is formed by the first block body and the second block body; and the second bar of the locking element is guided by a first side wall of the first block body to move to the inlet passage.

10. The positional stop device of claim 9, wherein the second bar of the locking element is guided by a second side wall of the second block body to move out of the outlet passage.

11. The positional stop device of claim 1, wherein the driving element comprises a driving body and a driving portion; the driving body couples to the first end of the lever and rotatablely couples to the driving portion; the driving body defines a receiving chamber for receiving the driving portion; and the driving portion is driven by the slider to be fully received in the receiving chamber from being partially exposed out of the receiving space.

* * * * *